United States Patent [19]

MacPhee

[11] 4,378,735

[45] Apr. 5, 1983

[54] ANTILINTING DEVICE FOR INK FOUNTAINS

[75] Inventor: John MacPhee, Rowayton, Conn.

[73] Assignee: Baldwin Gegenheimer Corporation, Stamford, Conn.

[21] Appl. No.: 263,514

[22] Filed: May 14, 1981

[51] Int. Cl.[3] ..... B41F 31/06; B41F 35/04

[52] U.S. Cl. ..... 101/363; 101/425; 101/364

[58] Field of Search ..... 101/364, 363, 350, 365, 101/425, 207, 208, 210, 366

[56] References Cited

U.S. PATENT DOCUMENTS

| | | | |
|---|---|---|---|
| 1,142,019 | 6/1915 | Buettner | 101/364 |
| 1,379,353 | 5/1921 | Marceau | 101/364 |
| 2,018,193 | 10/1935 | Smith | 101/366 |
| 2,377,110 | 5/1945 | Smith | 101/350 X |
| 2,986,088 | 5/1961 | Chase et al. | 101/350 |
| 3,010,393 | 11/1961 | Worthington | 101/363 |
| 3,128,699 | 4/1964 | Gegenheimer et al. | 101/364 |
| 3,252,416 | 5/1966 | Allen | 101/425 |
| 3,590,736 | 7/1971 | Malek | 101/363 |
| 3,710,714 | 1/1973 | Graupner | 101/364 |
| 3,848,529 | 11/1974 | Gegenheimer et al. | 101/363 |
| 4,074,627 | 2/1978 | Eck | 101/425 |
| 4,082,038 | 4/1978 | Ueno et al. | 101/425 |
| 4,108,068 | 8/1978 | Lambert | 101/363 |
| 4,254,709 | 3/1981 | Arnolds | 101/425 |

*Primary Examiner*—J. Reed Fisher

*Attorney, Agent, or Firm*—Morgan, Finnegan, Pine, Foley & Lee

[57] ABSTRACT

A device for scraping the ink film including lint and debris from an ink fountain roller consisting of a relatively thin, relatively narrow, flexible blade positioned in contact with the surface of the ink fountain roller, the blade being reciprocated along the length of the roller so as to remove ink, lint and debris from the surface of the roller to thereby prevent clogging of the ink metering nip.

5 Claims, 5 Drawing Figures

ANTILINTING DEVICE FOR INK FOUNTAINS

BACKGROUND OF INVENTION

This invention relates to ink fountains and more particularly to a device for preventing the clogging of the ink metering gap of ink fountains by lint or other debris emanating from paper being printed.

The present invention relates to the problems caused by the accumulation of paper lint in the ink fountains of offset lithographic presses when used to print newspapers and the like. The paper used in offset lithographic newspaper printing operations is uncoated in comparison with clay coated stock fibers used in commercial printing. With uncoated stock, the paper fibers are exposed and, therefore, it is possible for the paper fibers to be torn from the paper during the printing process. These paper fibers are commonly referred to as lint. The fibers which are torn and removed from the web become mixed in with the ink and, for reasons not fully understood, are transported along the ink train and eventually collect either in the ink fountain or on the rider rollers.

As is typical in the type of offset lithographic presses involved, there is an ink fountain blade which with associated structure forms an ink fountain. The ink fountain blade and the ink fountain roller have an adjustable gap therebetween which controls the amount of ink on the ink fountain roller. It is this gap which can become narrowed by the accumulation of lint on the ink fountain roller.

Operatively associated with the ink fountain is, typically, an ink agitator which may be cone shaped which agitates or mixes the ink in the desired manner. The ink agitator is connected to a structure such as that shown and described in a number of U.S. Pat. such as Nos. 3,848,529, 2,849,952, and 3,084,025 so that the cone shaped ink agitator rotates in an antirolling direction and traverses back and forth through the ink fountain so as to agitate and mix the ink.

It has been found that the lint which collects in the ink fountain is carried there by the ink train. In other words, the ink fountain roller is contaminated by lint because the lint is carried to the ink fountain by the roller train. This lint is then carried into the ink fountain by the film of ink on the fountain roller. While not completely understood, it is believed that as the film of ink exits from the ink fountain it is subjected to a shearing force which causes the lint to remain on the ink roller. The lint builds up on the ink fountain roller and is believed to be the primary cause for narrowing the metering gap. Eventually the lint on the fountain roller is dislodged causing further clogging of the metering gap.

The problem is that when lint collects or builds up on the ink fountain roller it can cause clogging of the ink metering gap formed at the juncture or nip of the ink fountain blade and the ink fountain roller. Since this metering gap governs the amount and/or thickness of ink which is fed onto the fountain roller, and to the ink roller train to the printing plate, clogging of the gap causes a starvation or reduction in the amount of ink feed to the train. When this occurs, the normal reaction of the pressman is to assume that more ink is needed and thus he makes an adjustment in order to increase the size of the gap between the ink fountain blade and the ink fountain roller. Frequently, when the gap is increased the buildup of debris in the gap is swept away, leaving a gap that is too wide, rsulting in too high an ink flow. The pressman must then close down the gap. Aside from occupying the pressman with a wasteful task, this problem also results in spoilage and paper waste in addition to the ink loss.

Pressmen experienced in the art are familiar with the problem of lint clogging the ink fountain nip. Consequently, when a reduction in ink feed occurs, the experienced perssman knows that widening the fountain metering gap is not the proper corrective action because, as described above, this will subsequently lead to too high a feed rate. Thus, the experienced pressman will attempt to correct the problem by sticking an ink knife or other sharp pointed device into the gap between the fountain blade and fountain roller to loosen the lint which is clogging the gap. While this generally succeeds in correcting the problem by loosening the lint, this remedy is only temporary since the lint will again collect and again clog the nip.

Another attempt to solve this problem is to provide the ink fountain roller with a spiral groove. However, this proposal is negated if the groove is not kept clean so as to avoid filling in with a mixture of lint and ink.

Another proposed solution which has been tried, is to use an ink agitator equipped with a cone having a very sharp point. The purpose of this approach is to accomplish automatically what the pressman does with his ink knife; namely, remove the lint which is clogging the gap. Although this approach has been tried on many occasions over the years, it requires accurately positioning the sharp edge in the ink metering nip, over the entire length of the fountain. Since the fountain may be as long as 68 inches on large newspaper presses, it has been proven to be very difficult to obtain such accuracy.

OBJECTS OF THE INVENTION

The object of this invention is to provide a new and improved system for offset lithographic presses which prevents the collection of lint in the ink metering gap which controls ink feeding to the ink fountain roller.

Another object of this invention is to provide a system for preventing lint from clogging the ink metering gap of an offset lithographic press.

A further object of this invention is to provide a new and improved device for preventing lint from clogging the ink metering nip of a printing press.

A still further object of this invention is to provide means extending immediately adjacent to the ink fountain roller which reciprocates along the length of the ink fountain roller so as to prevent lint buildup in the ink metering nip.

A still further object of this invention is to provide a blade means extending into contact with the ink fountain roller of a printing press which extends along the length of the ink fountain roller so as to prevent the accumulation of lint and debris in the ink metering nip.

A further object of the invention is to provide narrow blade means adapted to contact the surface of the ink fountain roller and adapted to reciprocate along the length of the ink fountain roller to thereby remove ink, lint and other debris from the surface of the ink fountain roller and prevent the accumulation of lint in the ink metering nip.

Addtional objects and advantages of the invention will be set forth in the description which follows and, in part, will be obvious from the description, the objects and advantages being realized and obtaned by means of the parts, instrumentation, methods apparatus and procedures particularly pointed out in the appended claims.

BRIEF DESCRIPTION OF THE INVENTION

Briefly described, the present invention provides a relatively simple solution to the vexing problem caused by lint clogging the nip between the ink fountain roller and the ink fountain blade.

In accordance with this invention means is provided for automatically and continuously preventing the buildup of lint in the gap between the ink fountain roller and the ink fountain blade by continuously and automatically removing the ink film from the fountain roller.

More particularly there is provided a relatively thin, relatively narrow, flexible blade adapted to engage the surface of the fountain roller which scrapes the film of ink and lint from the fountain roller before the roller portion being scraped enters the ink fountain or reaches the nip. The ink film which is removed from the roller surface enters the ink fountain or reservoir in the fountain where it is mixed with and diluted by fresh ink. The mixture containing a relatively low concentration of lint can then pass through the nip without causing clogging thereof.

More specifically, the invention includes a narrow blade in engagement with the ink fountain roller which is responsive to reciprocal movement of the agitator so that as the agitator moves back and forth, the blade moves back and forth so as to remove the ink film from the fountain roller.

The invention consists of the novel parts, steps, constructions and improvements shown and described.

The accompanying drawings which are incorporated in and constitute part of this specification illustrate an embodiment of the invention and, together with the description, serve to explain the principles of the invention.

OF THE DRAWINGS

DETAILED DESCRIPTION OF THE INVENTION

Figure 1:
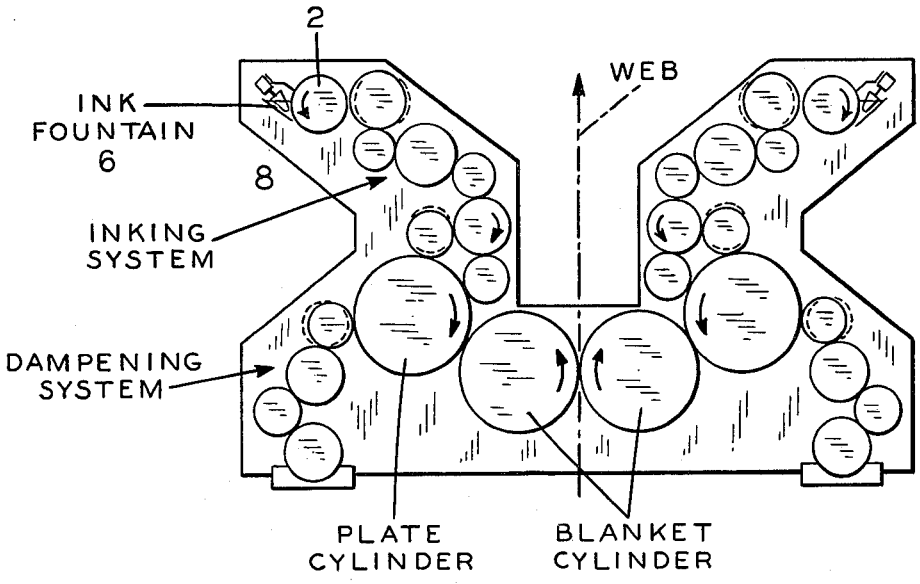
FIG. 1 is a schematic view showing the general environment of the present invention.
Figure 2:
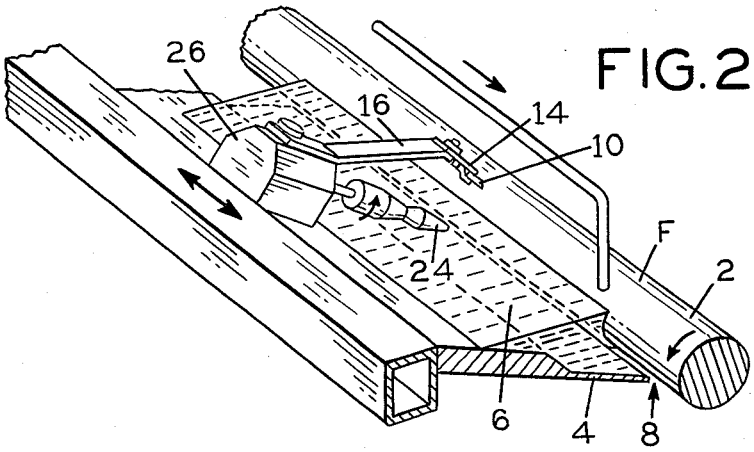
FIG. 2 is a perspective view partially in section of the invention.

The invention is particularly adapted for use with an offset lithographic printing press which is adapted to print paper. The roller train including the ink fountain roller 2, the ink fountain 6, the metering nip, the dampening system, the plate and blanket cylinders in conjunction with the web are shown in FIG. 1. The operation of this structure is well known in the art.

As is known, there is a nip or gap 8 between the ink fountain blade 4 and the ink fountain roller 2 which determines the thickness of ink on the ink fountain roller. As typical, the ink fountain roller is rotated by means, not shown, but well known in the art, so as to contact the ink within the ink fountain. The ink metering gap 8 controls the thickness of the ink film on the ink fountain roller. It is important this ink film be constant during a given operation.

As above indicated, a problem can occur when the press is used on uncoated paper stock such as used in printing newspaper and the like. In such instances debris in the form of lint caused by paper fibers being torn from the web stock may adhere to the fountain roller and be carried to the ink metering nip where it can clog the nip and decrease the size of the ink metering nip, causing an improper thickness of ink to be applied to the ink fountain roller.

In accordance with this invention means is provided for preventing the buildup of lint or debris in the ink metering gap. More particularly, this means comprises a relatively thin, relatively narrow, blade which is adapted to be positioned immediately adjacent to the surface of the ink fountain roller so as to scrape off and remove the ink film F including any debris, lint or the like from the ink fountain roller. There are two forms of the cleaning blade.

As embodied, the blade 10 consists of a relatively thin, substantially flat blade portion having a bevel 12 at the terminal end thereof. As embodied, the blade is relatively narrow, about ten percent the width of the fountain roller. In contrast, the usual doctor blade is about the same width as the ink fountain roller. The bevel is at an angle of approximately sixty degrees so as to engage and remove the film (F) from the ink fountain roller 2 before the roller comes into contact with ink coming from the nip 8. The blade 10 may be made of some suitable plastic material such as nylon. The film (F) contains lint and other debris and, of course, ink which if the film remained in the ink fountain roller would clog, narrow and eventually close the same. Although the ink lint mixture removed will fall into the ink fountain 6, it becomes mixed and diluted with fresh ink. The ink lint mixture at this point contains a relatively low concentration of lint which can pass through the ink metering nip 8 without clogging the ink metering nip.

The blade 10 is attached by rivots 13 or the like to the blade holder 14. The blade holder 14 and blade 12 form a sub-assembly which can be replaced in the event the blade 12 becomes worn.

Figure 3:
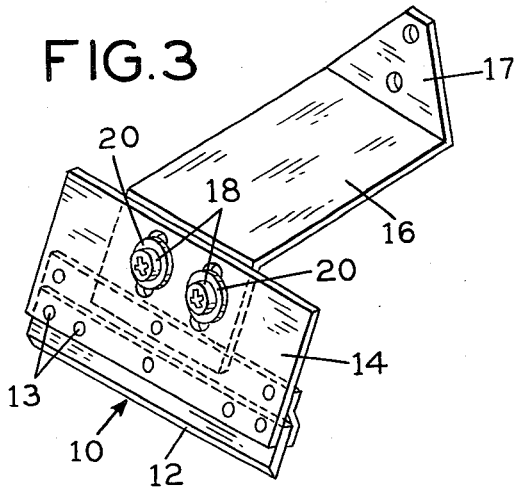
FIG. 3 is a perspective view of a sub-assembly of the invention.

The blade holder is adjustably connected to the main blade support 16. This is accomplished by means of a bolt 18, washer 20 and nut 22 (See FIGS. 3 and 4). There are slots in the blade holder 14 and the blade support 16 which permits the blade support 14 and blade 10 to be adjustably positioned with respect to the ink fountain roller 2.

The blade is reciprocated along the length of the ink fountain roller. As is typical in such arrangements, there is a cone shaped ink agitator 24 which is operatively associated with a driving head 26. There is means (not shown) for rotating the cone shaped ink agitator in a direction opposite from the rolling direction. There is also means (not shown) for causing the cone shaped ink agitator to reciprocate the agitator through the ink fountain bath. Such reciprocating means are known in the art and are shown as described in U.S. Pat. Nos. 3,848,529 issued Nov. 19, 1974 to H. W. Gegenheimer, 3,084,025 issued on Apr. 9, 1963 to H. W. Gegenheimer. Any of such constructions would be suitable in the present environment.

The main blade support 16 has an angled support extension 17 which is suitably attached to the ink agitator driving head 26 by screws 19 or other similar attaching means.

With this construction as the ink agitator traverses the length of the ink fountain and the ink fountain roller, the entire length of the ink fountain roller is scraped by the blade 10.

If it is desired that the entire ink fountain roller be scraped clean in one traverse of the ink agitator cone, then the speed of the ink agitator traverse must be adjusted so that in the time required for one revolution of the ink fountain roller, the agitator will move a distance equal to the length of the blade. This is not essential, however, in that it has been found satisfactory if the ink agitator and hence the scraping blade moves much more rapidly so that several traverses of the ink agitator are required to scrape the entire surface of the ink fountain roller.

Figure 4:
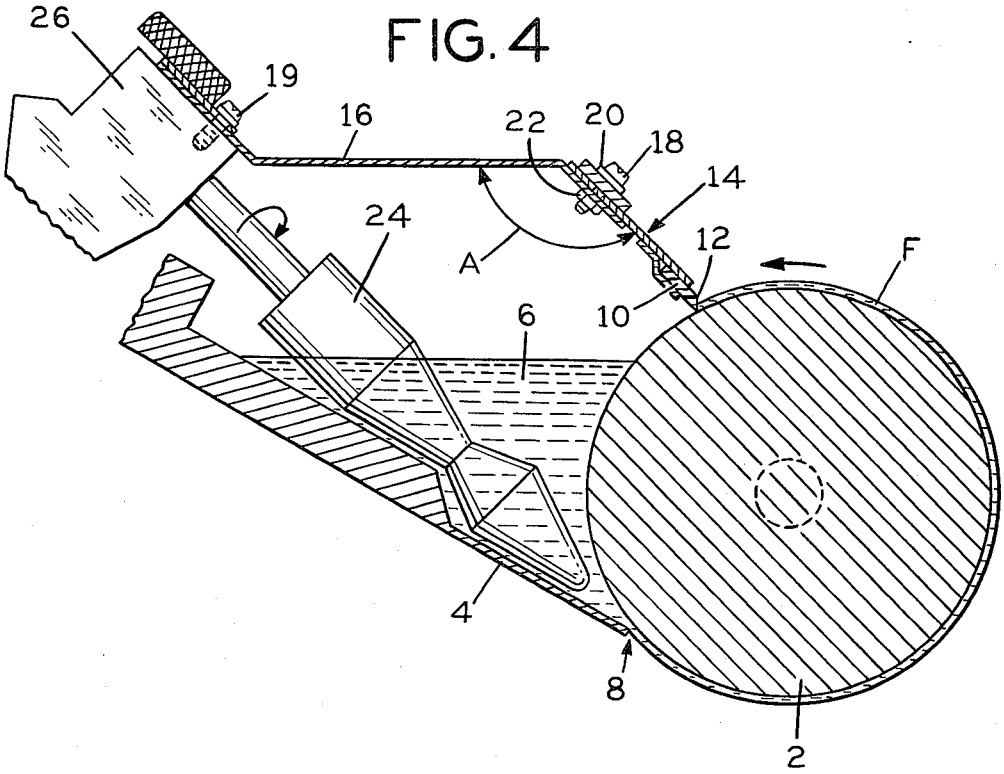
FIG. 4 is a cross-sectional view of the preferred embodiment of the invention.

FIG. 4 shows the preferred embodiment where the blade support 16 and blade holder 14 form an angle A. This construction provides clearance between the structure for the blade and the ink fountain and is helpful where space is at a premium.

Figure 5:
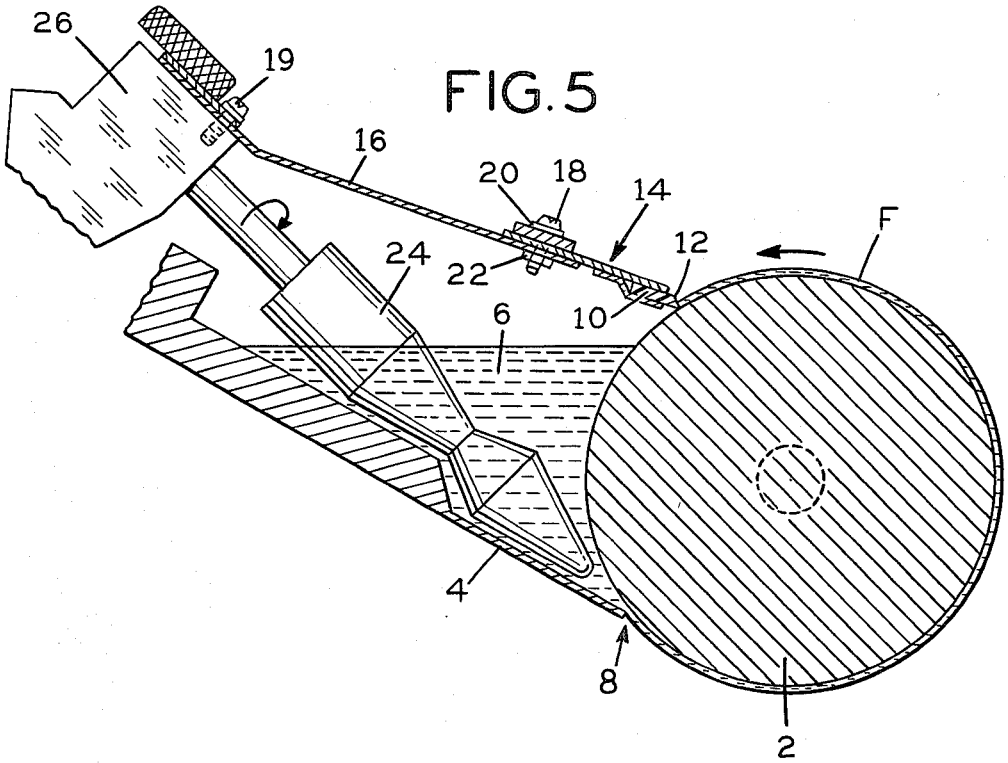
FIG. 5 is a view similar to FIG. 4 showing another embodiment of the invention.

Another embodiment is shown in FIG. 5 where the blade support 16 and the blade holder have a straight line relationship. This embodiment is used where additional space is not a requirement.

What is claimed is:

1. An antilinting system for use in a printing press having an ink fountain, an ink fountain blade, an ink fountain roller, an ink metering nip formed between the terminal end of the ink fountain blade and the ink fountain roller and an ink agitator means extending into said ink fountain and reciprocating along the full length of the ink fountain roller comprising:

(a) a blade holder having a relatively narrow, flexible, scraping blade adjustably attached to said blade holder;

(b) means for adjustably positioning said scraping blade adjacent the surface of said ink fountain roller and above said ink fountain so that said flexible blade can be moved a predetermined distance from the surface of said ink fountain roller so as to remove the ink film and lint on said ink fountain roller whereby the ink film and lint falls into said ink fountain and the lint will not clog said ink metering nip; and (c) means interconnecting said blade holder and said flexible scraping blade to said ink agitator means so that said flexible blade reciprocates back and forth along the entire length of said ink fountain roller so as to continuously remove ink and lint from said ink fountain roller.

2. An antilinting system as defined in claim 1 wherein said flexible scraping blade terminates in a bevel having an angle of about 60°.

3. An antilinting system as defined in claim 2 wherein the width of said scraping blade is about 10% of the width of said fountain roller.

4. An antilinting system as defined in claim 1 wherein said black holder extends from said ink agitator substantially parallel to said ink fountain and said flexible blade extends downwardly towards said ink fountain and is at an angle greater than 90° from said blade holder.

5. An antilinting system as defined in claim 1 wherein said blade holder and said flexible blade extend at an acute angle downwardly from said ink agitator towards said ink fountain roller.

* * * * *